US011648448B2

(12) United States Patent
Arnold

(10) Patent No.: US 11,648,448 B2
(45) Date of Patent: May 16, 2023

(54) MAGNUS EFFECT CYLINDRICAL PROJECTILE AND LAUNCHER

(71) Applicant: L. Taylor Arnold, Raleigh, NC (US)

(72) Inventor: L. Taylor Arnold, Raleigh, NC (US)

( * ) Notice: Subject to any disclaimer, the term of this patent is extended or adjusted under 35 U.S.C. 154(b) by 0 days.

(21) Appl. No.: 17/318,269

(22) Filed: May 12, 2021

(65) Prior Publication Data

US 2021/0354012 A1 Nov. 18, 2021

Related U.S. Application Data

(60) Provisional application No. 63/024,885, filed on May 14, 2020.

(51) Int. Cl.

| | |
|---|---|
| ***A63B 65/12*** | (2006.01) |
| ***A63H 33/18*** | (2006.01) |
| ***F41B 3/04*** | (2006.01) |
| ***A63B 59/30*** | (2015.01) |

(52) U.S. Cl.

CPC ..... *A63B 59/30* (2015.10); *A63B 65/122* (2013.01); *A63B 2225/01* (2013.01)

(58) Field of Classification Search

CPC ..... A63B 59/30; A63B 65/00; A63B 65/10; A63B 65/12; A63B 65/122; A63B 2225/01; A63H 33/18; F41B 3/04; A01K 15/025

USPC ..... 124/5

See application file for complete search history.

(56) References Cited

U.S. PATENT DOCUMENTS

| | | | | | |
|---|---|---|---|---|---|
| 2,167,992 | A * | 8/1939 | Olsen | A63B 67/086 | 473/505 |
| 2,321,371 | A * | 6/1943 | Du Pont | A63B 67/16 | 473/509 |
| 3,537,438 | A * | 11/1970 | Reed | F41J 9/28 | 124/43 |
| 3,901,208 | A * | 8/1975 | Laporte | F41J 9/28 | 124/43 |
| 4,222,361 | A * | 9/1980 | Jackson | F41B 3/00 | 124/35.1 |
| 4,452,007 | A * | 6/1984 | Martin | A63H 27/00 | 416/4 |
| 6,076,829 | A * | 6/2000 | Oblack | A63B 60/34 | 473/509 |
| 7,665,453 | B1 * | 2/2010 | D'Agostino | A63B 65/122 | 473/505 |
| 7,665,454 | B1 * | 2/2010 | D'Agostino | F41B 3/04 | 124/5 |
| 7,686,001 | B2 * | 3/2010 | Fitt | A63B 59/20 | 124/5 |
| 7,895,995 | B2 * | 3/2011 | Simon | A63H 33/18 | 473/460 |
| 7,900,617 | B1 * | 3/2011 | Kersh | F41J 9/30 | 124/5 |
| 8,015,968 | B2 * | 9/2011 | Christ | A63B 65/00 | 124/5 |

(Continued)

*Primary Examiner* — Alexander R Niconovich

(57) ABSTRACT

The present invention is a toy launcher system. A lightweight projectile has an exterior surface symmetrically disposed about an imaginary longitudinal axis and is generally spool-shaped. The launcher is composed of a shaft to which a flexible curled band is attached. The flexible curled band holds the projectile within its curvature. When the launcher is rotated by a user using a general throwing motion the band uncurls, thereby launching the projectile into flight.

4 Claims, 10 Drawing Sheets

(56) References Cited

U.S. PATENT DOCUMENTS 8,028,684 B1 * 10/2011 Weissmann ..... F41B 3/03 124/5
8,327,832 B2 * 12/2012 Henry ..... A63H 33/18 124/5
8,387,601 B1 * 3/2013 Christensen ..... F41J 9/28 124/5
8,418,681 B2 * 4/2013 Levin ..... A01K 39/014 124/5
8,511,292 B2 * 8/2013 Black ..... F41J 9/28 124/5
8,517,003 B2 * 8/2013 Fisher ..... A01K 15/025 124/5
8,539,939 B2 * 9/2013 Minneman ..... F41J 9/28 124/5
8,727,407 B2 * 5/2014 Parker ..... A21C 15/00 294/99.2
9,623,304 B2 * 4/2017 Clarke ..... A63B 59/20
9,683,807 B2 * 6/2017 Arnold ..... F41B 7/003
9,757,632 B2 * 9/2017 Fryer ..... A63B 65/122
9,855,510 B2 * 1/2018 Tarng ..... H04B 7/26
10,004,209 B2 * 6/2018 Hartelius ..... A01K 15/025
10,046,248 B2 * 8/2018 Arnold ..... F41B 7/08
10,378,865 B1 * 8/2019 Johannaber ..... F41J 9/28
10,512,854 B2 * 12/2019 Arnold ..... F41B 4/00
2005/0070198 A1 * 3/2005 Pickering ..... A63H 33/18 446/71
2005/0263962 A1 * 12/2005 Roh ..... A63B 65/00 473/509
2008/0127955 A1 * 6/2008 Christ ..... F41B 3/04 124/5
2012/0048251 A1 * 3/2012 Oblack ..... F41B 3/04 124/5
2013/0192535 A1 * 8/2013 Smith ..... A01K 15/025 119/707
2015/0047621 A1 * 2/2015 Palladino ..... A63B 59/20 124/5
2015/0090237 A1 * 4/2015 Williams ..... A63B 65/122 124/16
2016/0096095 A1 * 4/2016 Williams ..... A63B 60/34 124/5
2016/0213990 A1 * 7/2016 Mamangun ..... A63B 65/122
2019/0335713 A1 * 11/2019 Wills ..... A63B 59/20
2022/0022425 A1 * 1/2022 Ashlin ..... A01K 27/003

* cited by examiner

MAGNUS EFFECT CYLINDRICAL PROJECTILE AND LAUNCHER

CLAIM TO PRIORITY

This application claims under 35 U.S.C. § 120, the benefit of the Application 63/024,885, filed May 14, 2020, titled "Magnus Effect Cylindrical Projectile and Launcher" which is hereby incorporated by reference in its entirety.

COPYRIGHT AND TRADEMARK NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever. Trademarks are the property of their respective owners.

BACKGROUND

An object in flight that spins around an axis that is not aligned with its direction of travel is subject to the Magnus Effect.

As an object in motion spins, the part of the object that is spinning into the oncoming air creates a small area of high pressure. Conversely, the part of the object that is spinning away from the oncoming air creates an area of low pressure. The areas of low pressure and high pressure produce a vectored force that can cause an object in flight to alter its direction. This movement is known as the Magnus Effect in fluid dynamics. The Magnus Effect enables cylindrical or tubular projectiles, when given sufficient linear and rotational velocities, to achieve lift and to move in a generally looping fashion.

In the toy industry, the Magnus Effect has been implemented to affect interesting projectile flight patterns. The problem with existing technologies is the complexity of use. For instance, mechanisms that require wrapping a projectile with an elastic cord or string require hand and eye coordination that is beyond the skillset of many children and adults. In addition, elastic cords or strings are not easily aligned in the center of such a projectile. As a consequence, the projectile can easily be launched off-balance, destroying the necessary aerodynamic conditions and ruining the desired looping effect.

BRIEF DESCRIPTION OF THE DRAWINGS

Certain illustrative embodiments illustrating organization and method of operation, together with objects and advantages may be best understood by reference detailed description that follows taken in conjunction with the accompanying drawings in which.

DETAILED DESCRIPTION

Figure 1:
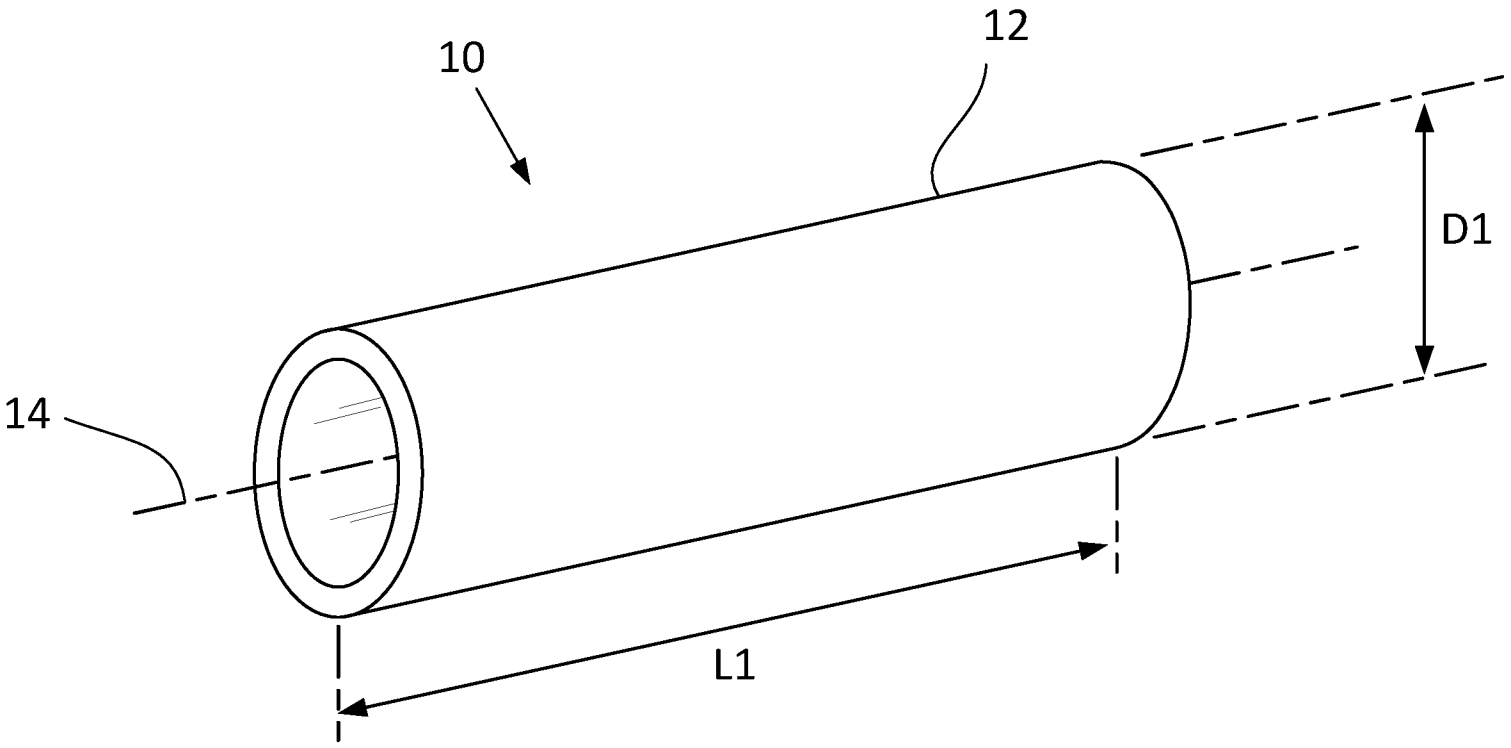
FIG. 1 is a perspective view of a projectile consistent with certain aspects of the present invention.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

The terms "a" or "an", as used herein, are defined as one, or more than one. The term "plurality", as used herein, is defined as two, or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an exemplary embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The present invention is a toy projectile and launcher system. The projectile is cylindrical in shape and lightweight. The projectile has an exterior surface that is symmetrically disposed about an imaginary longitudinal axis.

Although the present invention projectile and launcher can be embodied in many ways, only a few embodiments of the invention are illustrated and described. These embodiments are selected in order to set forth some of the best modes contemplated for the invention. The illustrated embodiments, however, are merely exemplary and should not be considered limitations when interpreting the scope of the appended claims.

In an embodiment, the present invention is a toy cylinder and launcher system characterized by a cylindrical projectile and a shaft-shaped launcher. The lightweight cylindrical projectile has an exterior surface symmetrically disposed about an imaginary longitudinal axis and in an embodiment is generally spool-shaped. The launcher is a shaft to which a flexible curled band is attached. The flexible curled band holds the projectile snugly within its curvature. When the launcher is rotated by a user using a general throwing motion the band uncurls, thereby launching the projectile into flight. The band may be made of any number of materials including, by way of non-limiting example, steel or other metal, plastic, fabric, and/or rubber. The band may be covered with one or more materials to enhance tactility, safety, and/or aesthetic appeal. Such cover materials may be any number of materials including, by way of non-limiting example, rubber, cloth, tape and/or paper.

In an embodiment, the present invention is a toy launcher system characterized by a cylindrical projectile having an exterior surface that is symmetrically disposed about an imaginary longitudinal axis and a launcher having a band attached to a shaft at the proximal end of said band. The band is flexible and holds said cylindrical projectile through circumferential application of a normal force. The band is flexibly able to curl into a circular shape that is capable of holding the cylindrical projectile snugly within the circumference defined by the circular shape. A user launches the cylindrical projectile through application of a linear motive force that acts upon the cylindrical projectile at a substantially right angle to said imaginary longitudinal axis. When the user provides such motive force manually, by application of a general throwing motion, or through application of a spring element or pneumatic piston element, the band uncurls and imparts to the cylindrical projectile both a linear velocity and a rotational velocity. The combination of said linear motive force and said normal force, imparting linear and rotational velocities, enables lift in the cylindrical projectile. This lift is in a direction perpendicular to said imaginary longitudinal axis. The cylindrical projectile, once airborne, proceeds to move along a generally looping path.

Figure 2:
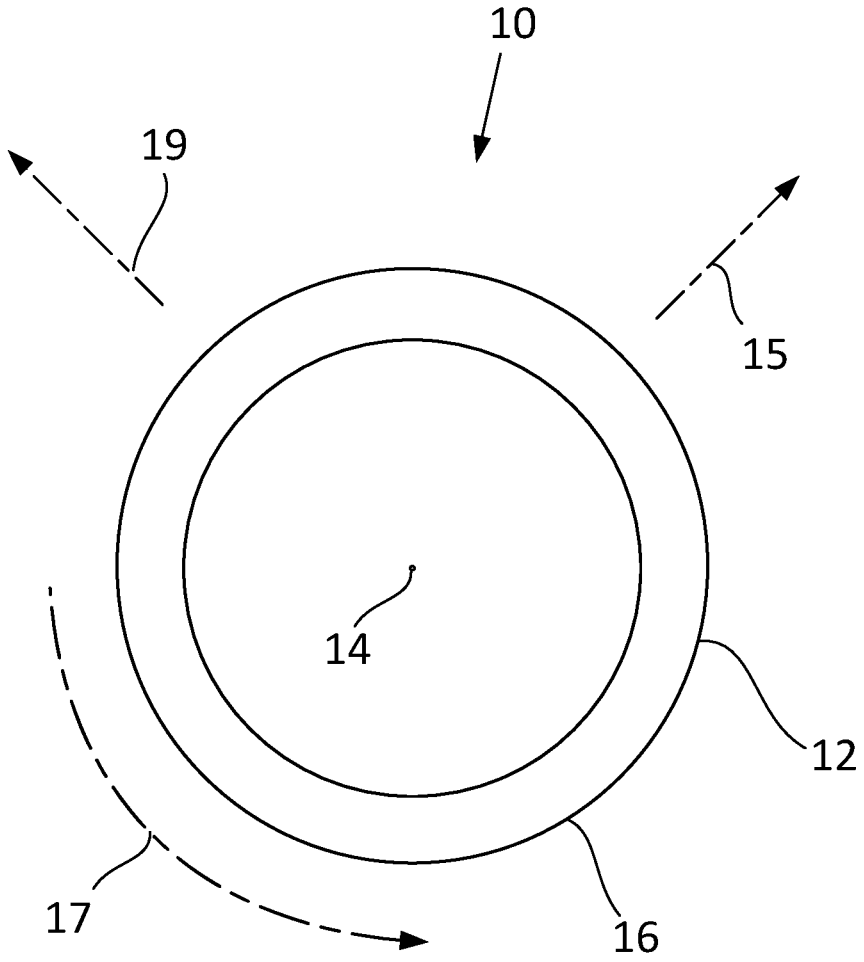
FIG. 2 is a side view of the projectile of FIG. 1 showing the forces that act upon the projectile in flight consistent with certain aspects of the present invention.

Referring to FIG. 1 and FIG. 2, a Standard Projectile 10 is shown. The Standard Projectile 10 has a Cylindrical Body 12 with a length L1 and a diameter D1. The Cylindrical Body 12 may be mostly hollow or composed of a lightweight substance, such as by way of non-limiting example, foam or foam rubber, in order to minimize weight. The length L1 is preferably at least three times as long as the diameter D1 is wide. The Cylindrical Body 12 is symmetrically formed about an imaginary long axis 14 that runs along its length L1 through the center of the Standard Projectile 10. The Cylindrical Body 12 can be fabricated from any suitably durable and lightweight material, including by way of non-limiting example, plastic, laminated paper, foam or foam rubber, among other materials.

In FIG. 2, the Standard Projectile 10 is shown in flight, wherein it is traveling in the primary direction of arrow 15. As the Standard Projectile 10 is traveling in the direction of arrow 15, it is also spinning about its long axis 14 in the direction of arrow 17. The spinning of the Standard Projectile 10 moves some of the air near the Exterior Surface 16 of the Standard Projectile 10. This air moved by the Standard Projectile 10 creates a slight high pressure under the Standard Projectile 10 and a slight low pressure above the Standard Projectile 10. The high pressure and low pressure act upon the Standard Projectile 10 and create a vectored Magnus force in the direction of arrow 19. The Magnus force is generally perpendicular to the forward direction of flight. The Magnus force therefore initially creates an upward force that inclines the direction of flight. As the Magnus force continues, it tends to cause the Standard Projectile 10 to fly vertically in a circle, therein producing a loop in flight. As such, the Magnus force tends to cause the Standard Projectile 10 to loop and return to its point of origin.

Figure 3:
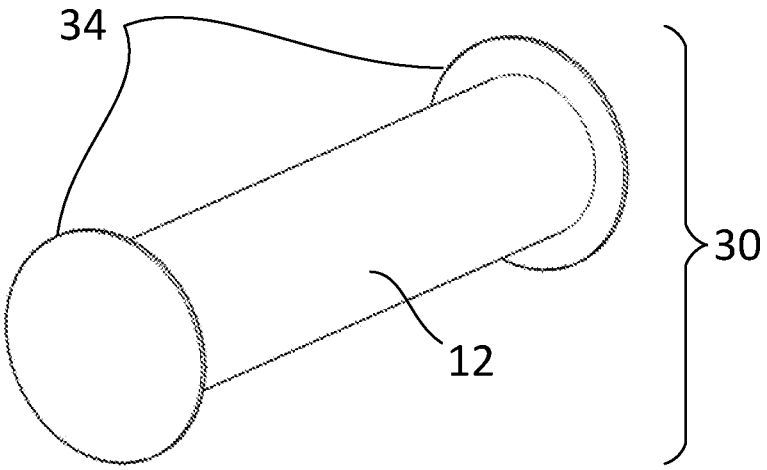
FIG. 3 is an isometric view of a generally spool-shaped projectile consistent with certain aspects of the present invention.

Turning now to FIG. 3, an isometric view of a generally spool-shaped projectile consistent with certain aspects of the present invention is shown. The generally Spool-Shaped Projectile 30 is composed of Cylindrical Body 12 and End Plates 34. End Plates 34 are composed of thin, lightweight, semi-rigid material such as but not limited to paper, plastic, foam, or foam rubber. In an embodiment End Plates 34 are about one-sixteenth inch in thickness. End Plates 34 are roughly circular in shape, with an outside diameter greater than the outside diameter of Cylindrical Body 12. In an embodiment the length of Cylindrical Body 12 is about four times the diameter of Cylindrical Body 12. While the specific measurements and shapes described herein refer to a particular embodiment of the invention, each measurement and shape can be varied without changing the nature of the invention.

Figure 4:
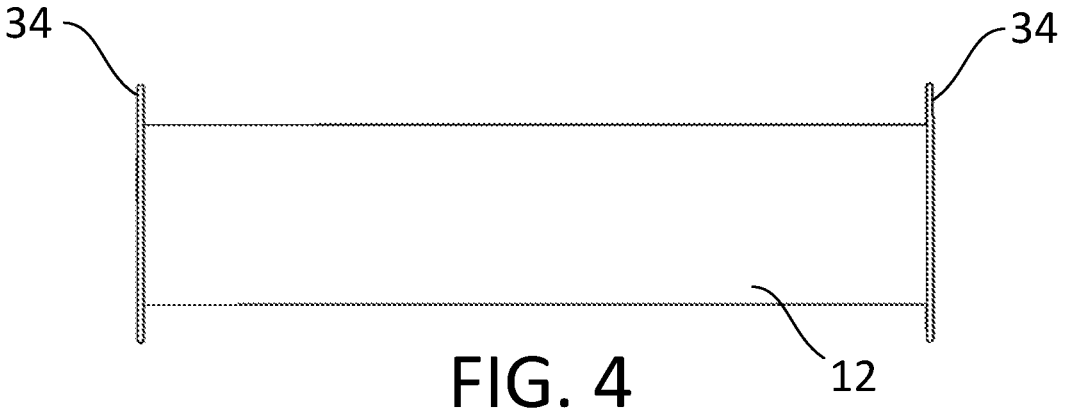
FIG. 4 is front view of the generally spool-shaped projectile of FIG. 3 consistent with certain aspects of the present invention.

Turning now to FIG. 4, a front view of the generally spool-shaped projectile of FIG. 3 consistent with certain aspects of the present invention is shown. End Plates 34 are chemically or mechanically attached to Cylindrical Body 12.

Figure 5:
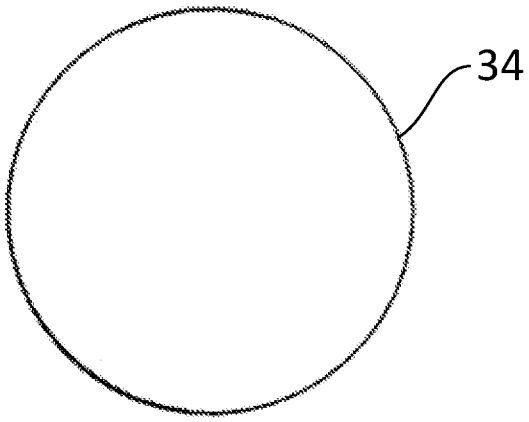
FIG. 5 is a side view of the generally spool-shaped projectile of FIG. 3 consistent with certain aspects of the present invention.

Turning now to FIG. 5, a side view of the generally spool-shaped projectile of FIG. 3 consistent with certain aspects of the present invention is shown, such that only one End Plate 34 is visible.

Figure 6:
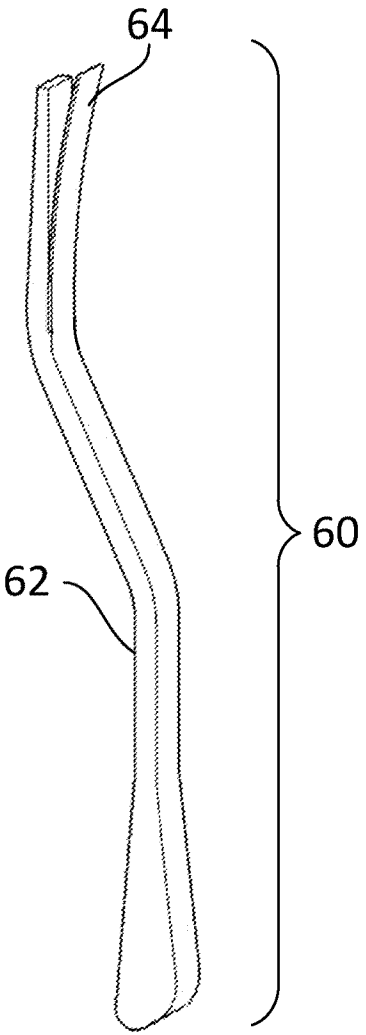
FIG. 6 is an isometric view of a launch device embodiment with band uncurled consistent with certain aspects of the present invention.

Turning now to FIG. 6, an isometric view of the launch device embodiment with band uncurled consistent with certain aspects of the present invention is shown. Launch device 60 includes Shaft 62 and Flexible Curled Band 64. In an embodiment, Flexible Curled Band 64 may be, by way of non-limiting example, a steel ribbon or bi-stable steel ribbon. Other materials may be employed for Flexible Curled Band 64 such as, but not limited to, plastic, fabric, rubber, and paperboard. Flexible Curled Band 64 may be entirely covered in a safe, durable, flexible, and decorative material such as, by way of non-limiting example, silicone rubber. Among other non-limiting materials for the covering are plastic film, plastic tape, paper tape, and fabric. In an embodiment, such covering may increase the friction between the Flexible Curled Band 64 and any object against which it is placed. Flexible Curled Band 64 is secured to Shaft 62 at the proximal end of Flexible Curled Band 64, the other end of Flexible Curled Band 64 being free to alternately extend away from the user or to curl inwardly upon itself in a generally concentric fashion. In an embodiment the total length of the free end of Flexible Curled Band 64 is about equal to the outside circumference of the Cylindrical Body (not shown).

Figure 7:
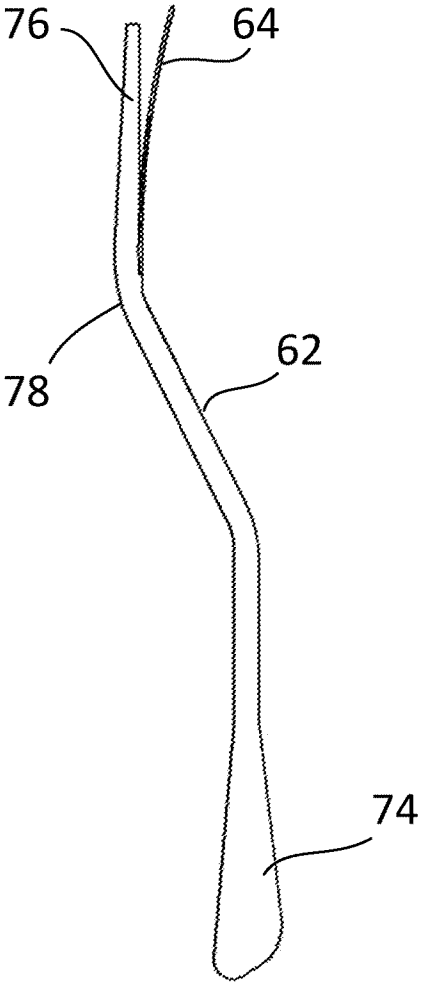
FIG. 7 is a side view of the launch device embodiment of FIG. 6 consistent with certain aspects of the present invention.

Turning now to FIG. 7, a side view of the launch device embodiment of FIG. 6 consistent with certain aspects of the present invention is shown. Shaft 62 tapers from end of Handle 74 to tip of Launchpad 76. In an embodiment Shaft 62 is generally S-shaped and measures about fifteen inches from the end of Handle 74 to tip of Launchpad 76. Launchpad 76 forms the portion of Shaft 62 from Main Bend 78 to the tip of Launchpad 76. In an embodiment, Main Bend 78 has an inside angle measurement of about 140 degrees. Flexible Curled Band 64 extends about from Main Bend 78 to the tip of Launchpad 76. While the specific measurements and shapes described herein refer to a particular embodiment of the invention, each measurement and shape can be varied without changing the nature of the invention.

Figure 8:
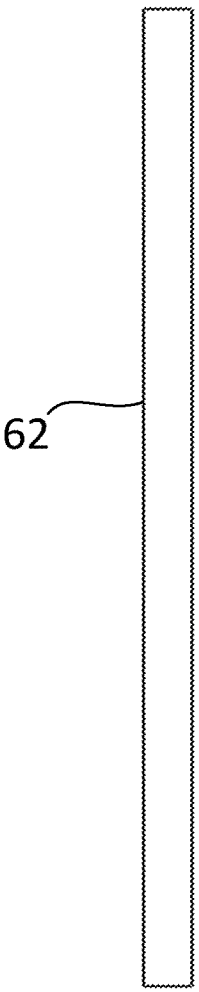
FIG. 8 is a rear view of the launch device embodiment of FIG. 6 consistent with certain aspects of the present invention.

Turning now to FIG. 8, a rear view of the launch device embodiment of FIG. 6 consistent with certain aspects of the present invention is shown. In the figure, only Shaft 62 is visible.

Figure 9:
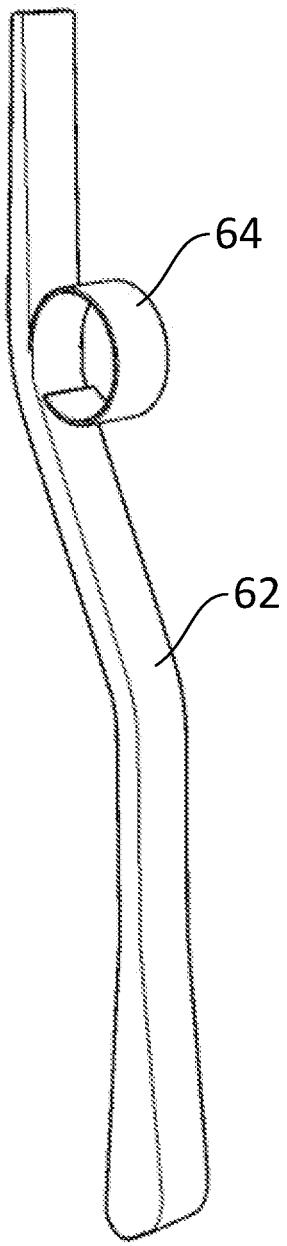
FIG. 9 is an isometric view of the launch device embodiment with band curled consistent with certain aspects of the present invention.

Turning now to FIG. 9, an isometric view of the launch device embodiment with band curled consistent with certain aspects of the present invention is shown. Flexible Curled Band 64 is chemically or mechanically attached to Shaft 62 at the proximal end of Flexible Curled Band 64.

Figure 10:
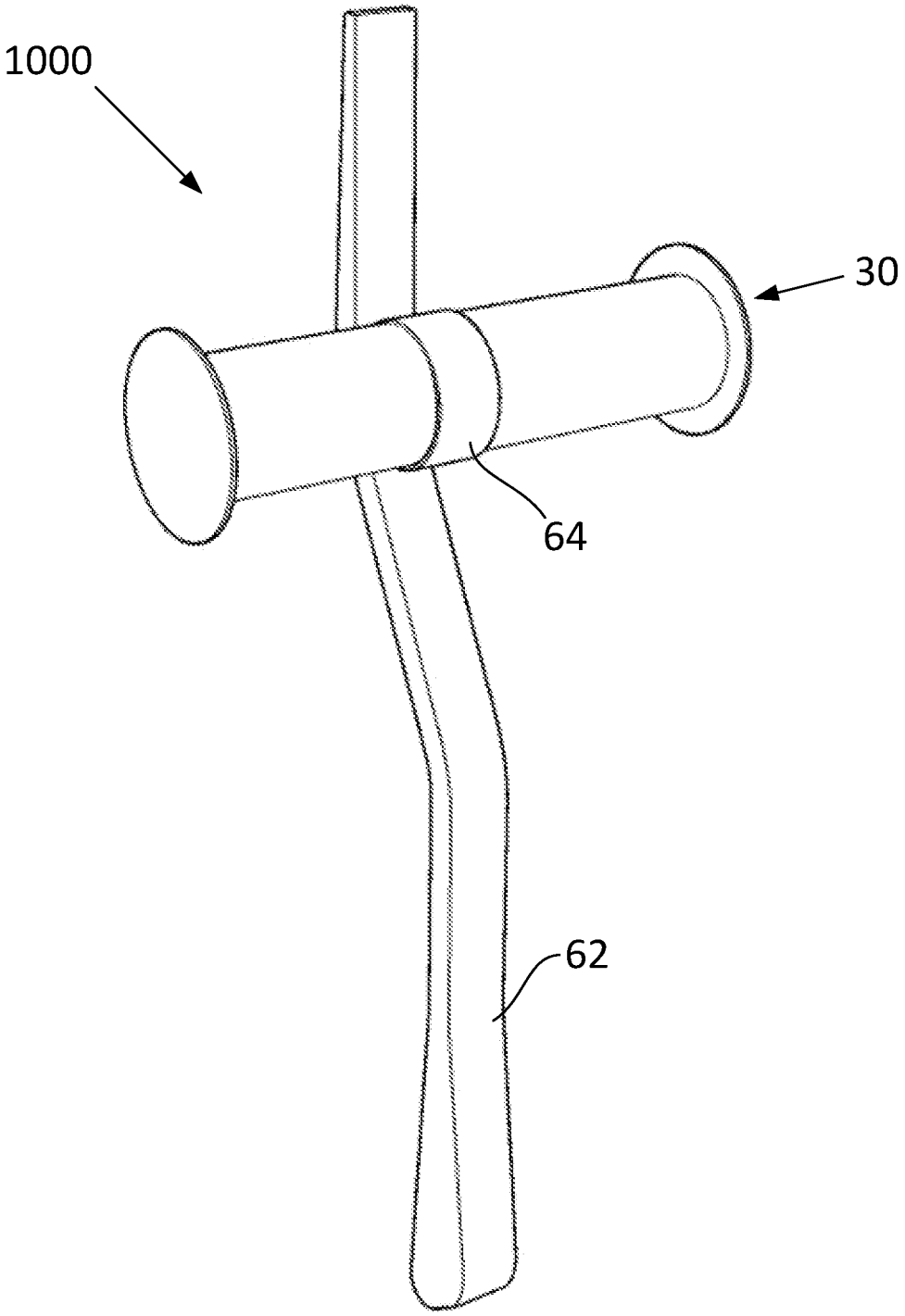
FIG. 10 is an isometric view of the assembly consisting of the generally spool-shaped projectile of FIG. 3 loaded onto the launch device embodiment of FIG. 9 consistent with certain aspects of the present invention.

Turning now to FIG. 10, an isometric view of the Assembly 1000 consisting of the generally spool-shaped projectile of FIG. 3 loaded onto the launch device embodiment of FIG. 9 consistent with certain aspects of the present invention is shown. Spool-Shaped Projectile 30 is shown with Flexible Curled Band 64 wrapped around it such that the free end of Flexible Curled Band 64 curls over the top of Spool-Shaped Projectile 30 and holds Spool-Shaped Projectile 30 against the front of Shaft 62.

Figure 11:
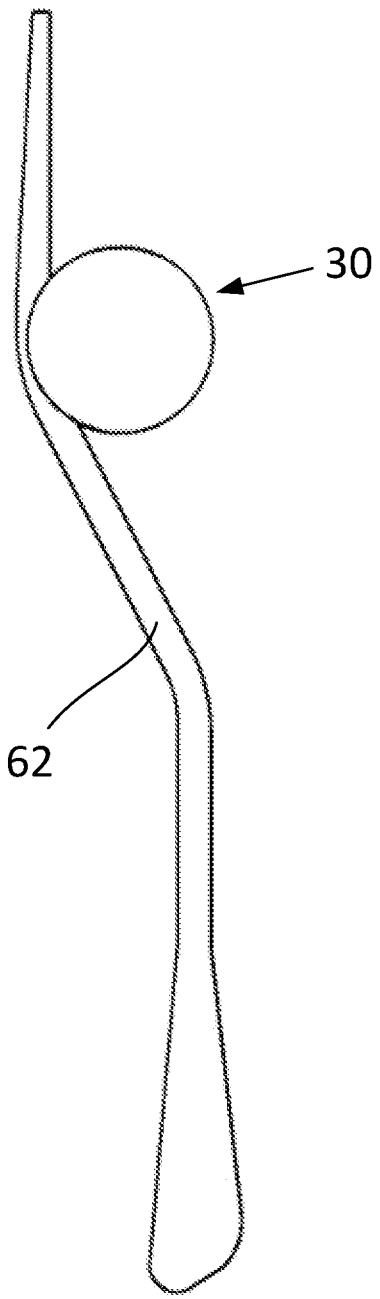
FIG. 11 is a side view of the assembly of FIG. 10 consistent with certain aspects of the present invention.

Turning now to FIG. 11, a side view of the assembly of FIG. 10 consistent with certain aspects of the present invention is shown. Spool-Shaped Projectile 30 is shown held against the front of Shaft 62.

Figure 12:
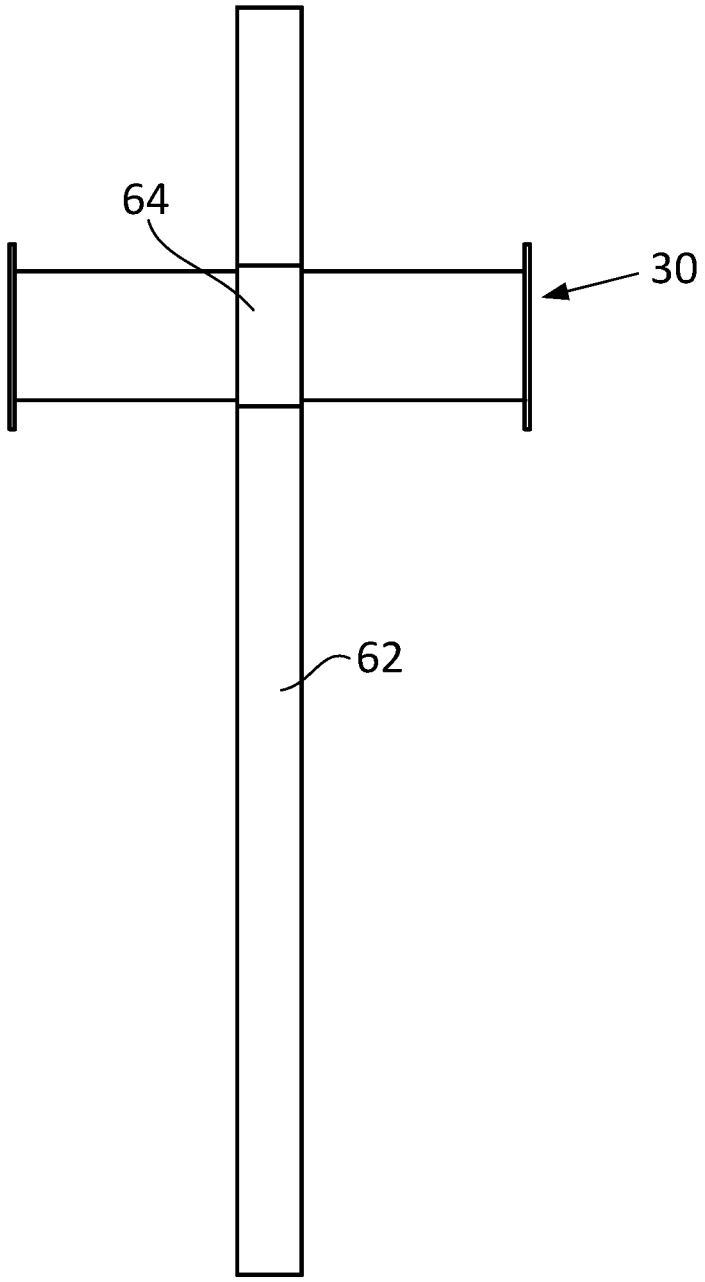
FIG. 12 is a front view of the assembly of FIG. 10 consistent with certain aspects of the present invention.

Turning now to FIG. 12, a front view of the assembly of FIG. 10 consistent with certain aspects of the present invention is shown. Spool-Shaped Projectile 30 is shown held against the front of Shaft 62 by Flexible Curled Band 64.

Figure 13:
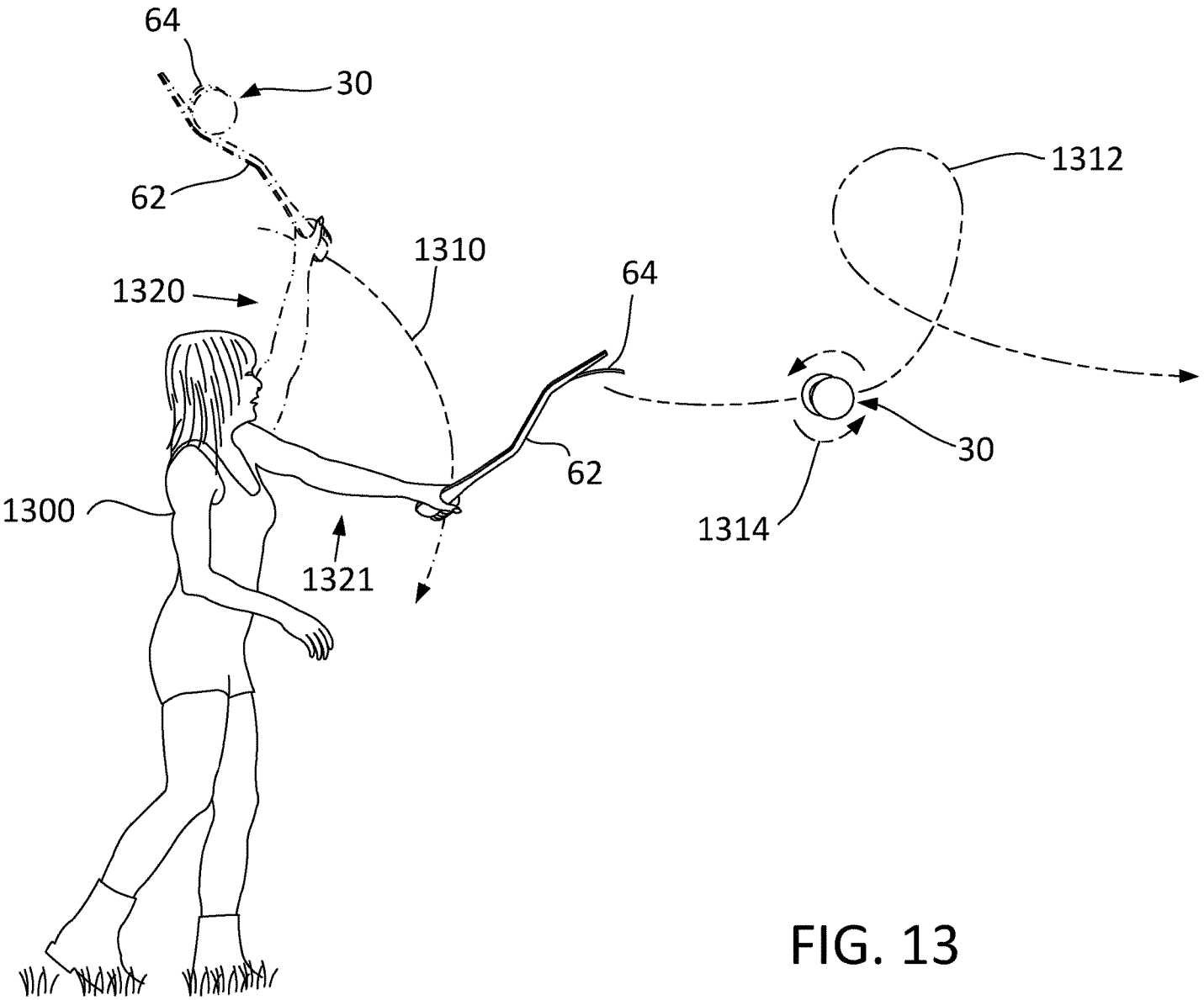
FIG. 13 is an in-use view of the assembly of FIG. 10 consistent with certain aspects of the present invention.

Turning now to FIG. 13, an in-use view of the assembly of FIG. 10 consistent with certain aspects of the present invention is shown. In an embodiment, User 1300 holds the assembly of FIG. 10 in one hand and moves the assembly with a general throwing motion, moving the assembly from First Position 1320 to Second Position 1321. In an embodiment, the thumb of the throwing arm of User 1300 lays along the surface of the Shaft 62 that is opposite to the surface of the Shaft 62 upon which the Flexible Curled Band 64 is affixed (not shown). At First Position 1320, Flexible Curved Band 64 securely holds Spool-Shaped Projectile 30 within the space defined by its curvature. As User 1300 moves the assembly along Arc 1310 from First Position 1320 into Second Position 1321, forces caused by User's motion cause the Flexible Curved Band 64 to uncurl, generally imparting a Rapid Rotational Velocity 1314 to Spool-Shaped Projectile 30. User's motion also imparts to Spool-Shaped Projectile 30 a linear velocity while it is spinning. The forward projection away from User 1300 and the Rapid Rotational Velocity 1314 creates a Magnus force that launches Spool-Shaped Projectile 30 into flight. The Spool-Shaped Projectile 30 tends to fly up and around in a Looping Flight Path 1312. Alternatively, Standard Projectile 10 may be substituted for Spool-Shaped Projectile 30 (not shown.)

Figure 14:
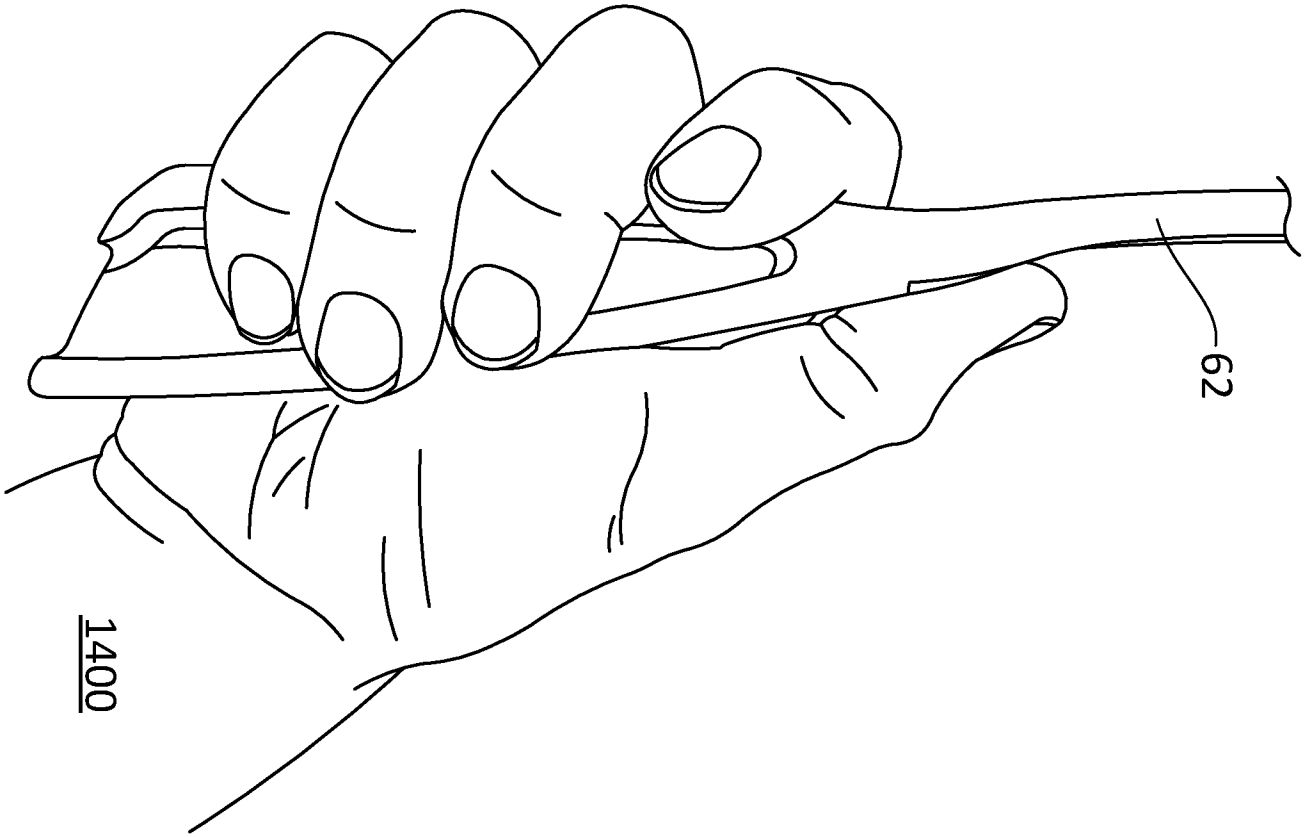
FIG. 14 is a side view of the handle of a launch device embodiment consistent with certain aspects of the present invention.

Turning now to FIG. 14, a side view of the handle of a launch device embodiment consistent with certain aspects of the present invention is shown. At 1400, the thumb of the throwing arm of a user lays along the rear of Shaft 62. The rear of Shaft 62 is the surface of Shaft 62 that is opposite to the surface of the Shaft 62 upon which the Flexible Curled Band (not shown) is affixed.

While certain illustrative embodiments have been described, it is evident that many alternatives, modifications, permutations and variations will become apparent to those skilled in the art in light of the foregoing description.

I claim:

1. A toy launcher system, comprising:

a launcher;

a cylindrical projectile having an exterior surface that is symmetrically disposed about an imaginary longitudinal axis;

a metal and/or plastic band having an end proximal to a user;

the metal and/or plastic band attached to said launcher at the end of said metal and/or plastic band proximal to a user, where the metal and/or plastic band holds said cylindrical projectile through circumferential application of a normal force and enables secure holding of said cylindrical projectile to said launcher;

launching said cylindrical projectile through application of a motive force, where said motive force acts upon said cylindrical projectile at a substantially right angle to said imaginary longitudinal axis;

said motive force and said normal force enabling lift in said cylindrical projectile in a direction perpendicular to said imaginary longitudinal axis.

2. The system according to claim 1, where said motive force is provided by manual application.

3. The system of claim 2, where said manual application includes a general throwing motion.

4. The system of claim 1, where said cylindrical projectile is spool shaped.

* * * * *